United States Patent [19]

Stevens

[11] 4,134,178

[45] Jan. 16, 1979

[54] ADJUSTABLE ROLLER ASSEMBLY FOR SLIDING DOORS AND THE LIKE

[75] Inventor: Richard G. Stevens, Rockford, Ill.

[73] Assignee: Amerock Corporation, Rockford, Ill.

[21] Appl. No.: 844,803

[22] Filed: Oct. 25, 1977

[51] Int. Cl.[2] ..... E05D 13/02

[52] U.S. Cl. ..... 16/100; 16/105

[58] Field of Search ..... 16/100, 105, 97

[56] References Cited

U.S. PATENT DOCUMENTS

| | | | |
|---|---|---|---|
| 2,944,300 | 7/1960 | Swanson | 19/254 |
| 3,237,238 | 3/1966 | Anderson | 16/105 |

OTHER PUBLICATIONS

Wheel Unit Blue Print Submitted by Applicant as Prior Art.

*Primary Examiner*—Dorsey Newton

*Attorney, Agent, or Firm*—Leydig, Voit, Osann, Mayer & Holt, Ltd.

[57] ABSTRACT

A roller assembly for sliding doors and the like includes a case adapted for mounting on the door and forming a cavity that is open at the end adjacent the sliding edge of the door, a carrier located within the cavity of the case and mounted for reciprocating movement relative to the open end of the cavity, and at least one roller journaled on the carrier adjacent the open end of the cavity and projecting beyond the case. A cam is journalled on the case, and a cam follower is provided on the carrier for adjusting the position of the carrier in response to rotational movement of the cam. The case comprises a unitary molded plastic member with the bearings for the cam being formed by a pair of opposed walls of the case, and the bearings open into a pair of slots extending continuously from the bearings to one end of the case for admitting the cam into the bearings as the carrier is inserted into the case. The case is sufficiently resilient to permit the opposite edges of each slot to be moved away from each other as the cam is urged into the bearings, with the opposite edges of the slots then returning to their original positions to hold the cam captive in the bearings. The cam forms an arcuate slot holding the follower captive therein and extending along an arc that is eccentric with respect to the axis of rotation of the cam, so that rotation of the cam in opposite directions moves the carrier in opposite directions within the case. One of the arcuate edges of the cam slots forms a plurality of detents for positioning the follower at selected locations along the length of the arcuate slot.

6 Claims, 5 Drawing Figures

ADJUSTABLE ROLLER ASSEMBLY FOR SLIDING DOORS AND THE LIKE

DESCRIPTION OF THE INVENTION

The present invention relates to roller assemblies for doors and other closure members mounted for movement along a supporting or guiding track.

It is a primary object of the present invention to provide an improved roller assembly that can be efficiently and economically manufactured from a small number of parts which are easily assembled. In this connection, a related object of the invention is to provide such an improved roller assembly which permits adjustment of the roller position inwardly and outwardly regardless of whether the assembly is installed in a door (or other closure member).

It is another object of this invention to provide an improved roller assembly of the foregoing type which can be manufactured with a relatively small number of forming and assembling steps.

Other objects and advantages of the invention will be apparent from the following detailed description and the accompanying drawings, in which.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined by the appended claims.

Figure 1:
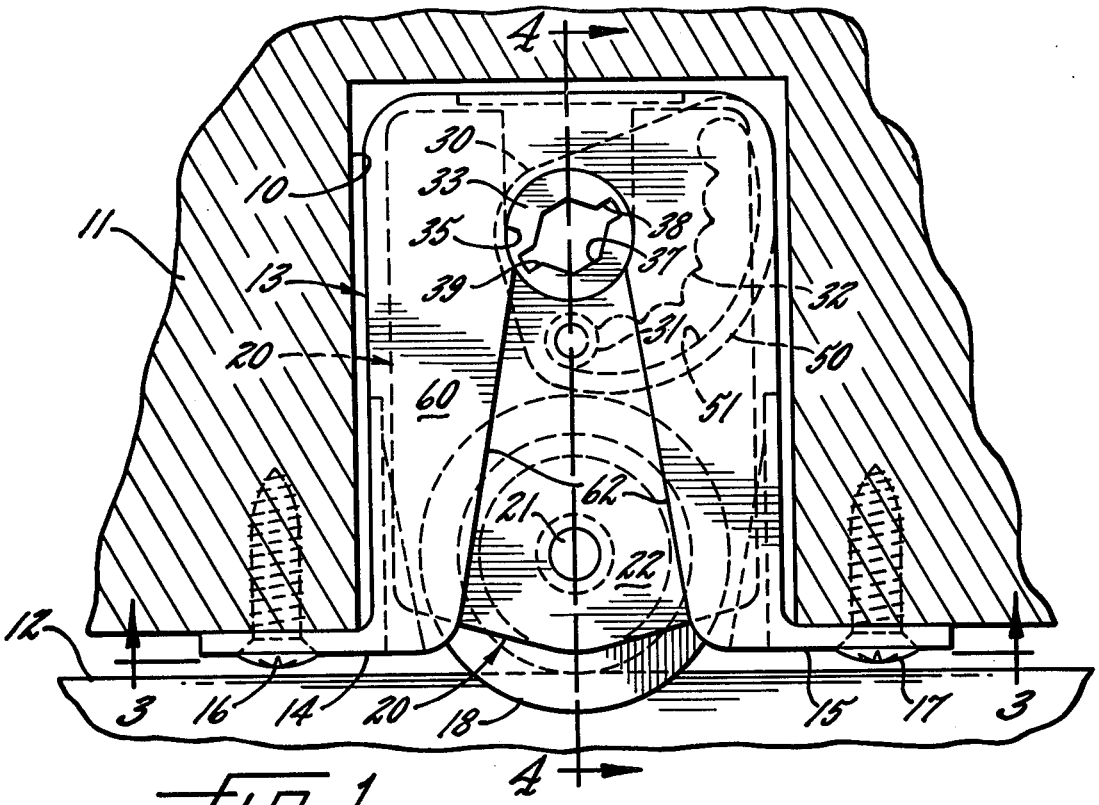
FIG. 1 is a side elevation of a roller assembly embodying the invention and installed on a sliding door riding on a supporting track, and with the roller in its most retracted position.

Turning now to the drawings and referring first to FIG. 1, there is shown a roller assembly mounted within a cavity or cutout 10 in a sliding door 11 which is supported and guided during sliding movement by a horizontal track 12. Although only one roller assembly is shown in FIG. 1, it will be appreciated that two such roller assemblies will normally be mounted at opposite ends of the lower edge of most sliding doors or other closure members. For the purpose of securing the roller assembly to the door, the case 13 of the roller assembly forms a pair of flanges 14 and 15 which extend outwardly beyond the cavity 10 along the lower edge of the door for attachment to the door by means of a pair of screws 16 and 17. A roller 18 extends downwardly beyond the lower surfaces of the flanges 14 and 15 to rest on the track 12 while holding the door 11 slightly elevated above the top surface of the track 12. As is conventional, the periphery of the roller 18 is grooved to mesh with the track 12 and thereby stabilize the lower end of the door 11 against lateral movement in a direction perpendicular to the path of sliding movement.

Figure 2:
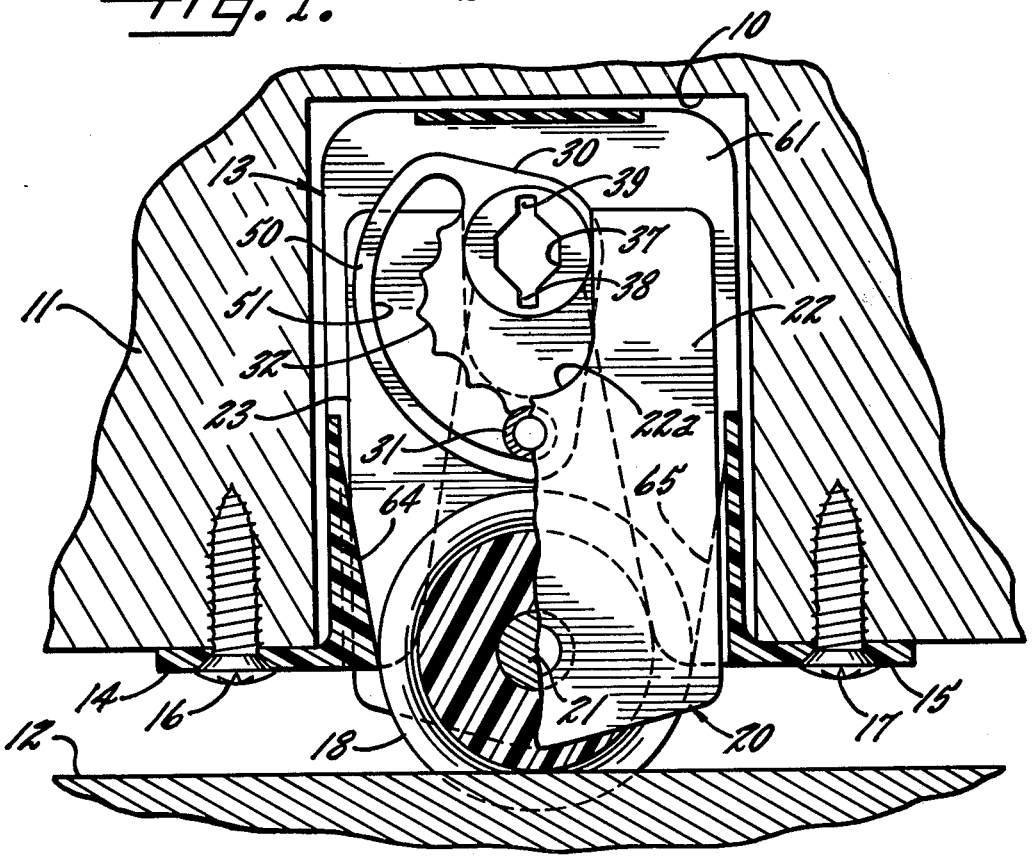
FIG. 2 is a side elevation, partially in section, of the same roller assembly shown in FIG. 1 with the roller in its most advanced position.
Figure 3:
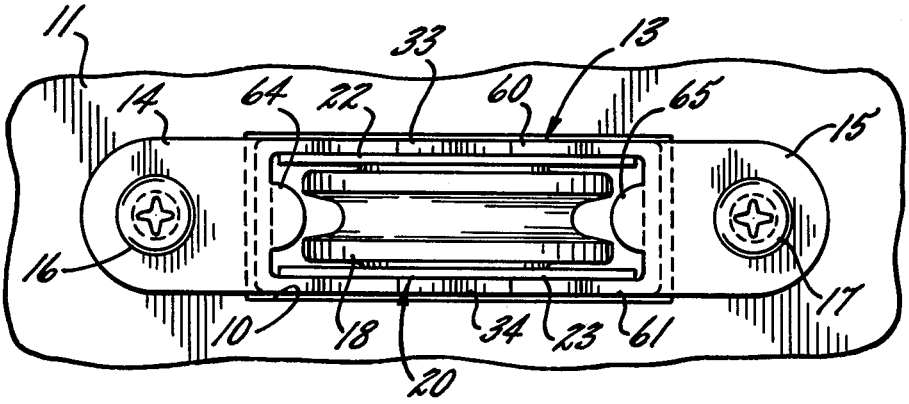
FIG. 3 is a bottom plan view taken generally along line 3—3 in FIG. 1.

To permit adjustment of the space between the lower edge of the door 11 and the top edge of the track 12, the roller 18 is journaled in a carrier 20 which is telescoped within the internal cavity of the case 13 and mounted for limited reciprocating movement within the case 13. In FIG. 1, the roller 18 and the carrier 20 are shown in their most retracted position, providing a minimum clearance between the lower edge of the door 11 and the top edge of the track 12. In FIG. 2, the roller 18 and the carrier 20 are shown in their most advanced position, providing a maximum clearance between the door and the track. This adjustability of the vertical position of the roller 18 is desirable to permit squaring of the door within its frame and/or to facilitate proper positioning of the top edge of the door within the guiding channel that is normally provided at the top of the door frame to guide the top edge of the door during its sliding movement. In the particular embodiment illustrated, the roller 18 is journaled on the carrier 20 by means of a shaft 21 which extends through the center of the roller 18 and is staked to a pair of side plates 22 and 23 which form the carrier 20.

For the purpose of effecting vertical movement of the carrier 20 and the roller 18 within the case 13, a cam 30 is journaled on the case 13 and acts on a cam follower 31 on the carrier 20. More specifically, the cam 30 includes a serrated or notched surface 32 which follows an arc that is eccentric with respect to the axis of rotation of the cam 30. Consequently, as the cam is rotated from the position shown in FIG. 1 to the position shown in FIG. 2, the cam surface 32 advances the cam follower 31 toward the lower edge of the door, thereby lowering the carrier 20 and the roller 18 journaled thereon. Of course, as the roller 18 is lowered relative to the case 13, the clearance space between the bottom edge of the door 11 and the top edge of the track 12 is increased.

Figure 4:
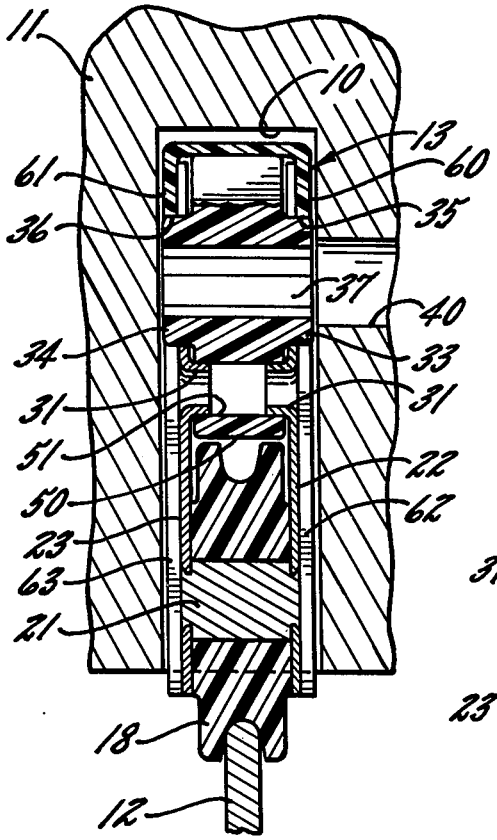
FIG. 4 is a vertical section taken generally along line 4—4 in FIG. 1.
Figure 5:
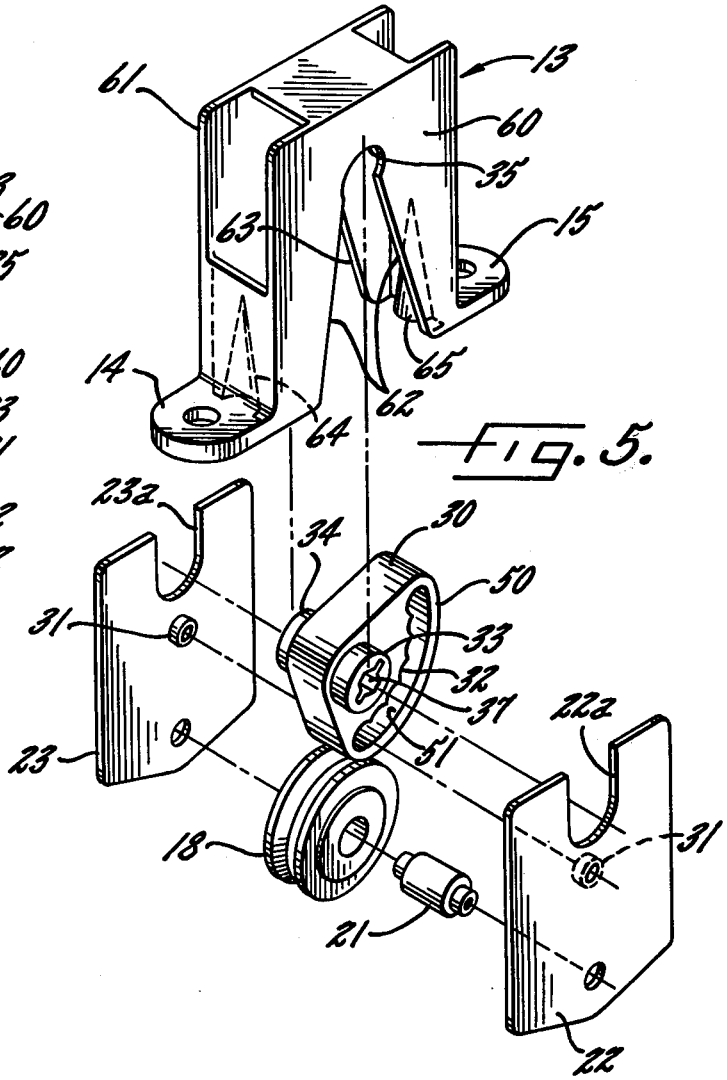
FIG. 5 is an exploded perspective view of the roller assembly shown in FIG. 1.

As can be seen most clearly in FIG. 5, the cam 30 is journaled on the case 13 by means of a pair of laterally projecting stub shafts 33 and 34. These stub shafts 33 and 34 project through vertically elongated slots 22*a* and 23*a* in the side plates of the carrier 20 and fit into a pair of apertures 35 and 36 in the side walls of the case 13. Thus, the cam 30 is carried by the case 13, and the elongated slots 22*a* and 23*a* in the side walls of the carrier 20 permit vertical movement of the carrier 20 without interfering with the stub shafts 33 and 34 of the cam. To facilitate manual rotation of the cam 30, a hexagonal aperture 37 extends through the cam in line with the axis of the stub shafts 33 and 34 to receive an Allen wrench, and diammetrically opposed grooves 38 and 39 extend the walls of the hexagonal aperture to permit the cam to be turned by a screwdriver. It will be appreciated that these tools may be inserted into the cam to adjust the position of the roller 18 either before or after the roller assembly is mounted on the door or other closure member, provided an access opening 40 (FIG. 4) is formed in at least one side of the door to permit entry of the tool into the roller assembly after it has been mounted in the door.

In accordance with one important aspect of the present invention, the roller-adjusting cam forms an arcuate slot which holds the cam follower captive therein for movement along the desired eccentric arc. Thus, in the illustrative embodiment, the cam 30 includes an arcuate rib 50 which forms the outboard wall of an arcuate slot 51 containing the cam follower 31. That is, the rib 50 forms the outboard wall of the slot 51, and the serrated cam surface 32 forms the inboard wall of the slot. This construction permits the single unitary cam 30 to control movement of the cam follower in both directions, i.e., both upward and downward movement, in response to clockwise and counterclockwise movement of the cam, respectively (as viewed in FIG. 1). More specificially, during clockwise movement of the cam 30 as viewed in FIG. 1, the serrated cam surface 32 moves the cam follower 31 progressively farther away from the axis of rotation of the cam 30, with the detents formed by the serrated surface 32 producing a readily discernible click each time the follower 31 seats in one of the troughs of the serrated surface. The number of clicks thus indicates the extent of the lowering movement of the roller 18 as the cam 30 is rotated in the clockwise direction.

When the cam 30 is rotated in the counterclockwise direction as viewed in FIG. 1, the cam follower 31 is progressively raised toward the axis of cam rotation. Again, the serrated surface 32 provides a succession of detent positions, with the resulting audible clicks indicating the extent of upward movement of the roller 18. When the cam rotation is stopped at any given detent position, the cam follower is held in that position by the serrated surface 32 until the cam 30 is again turned with sufficient force to cause the follower 31 to ride over one of the projecting ridges of the serrated surface 32. In this connection, it should be noted that the arcuate rib 50 which forms the outboard wall of the arcuate slot 51 is sufficiently resilient to permit relative movement of the cam and the follower between successive detent positions. The entire cam 30, including the stub shafts 33 and 34, the serrated surface 32 and the arcuate rib 50, is preferably formed from a polymeric material in a single molding operation.

In accordance with a further aspect of the invention, the case of the roller assembly comprises a unitary molded plastic member with the bearings for the cam being formed by a pair of opposed walls of the case, and with the bearings opening into a pair of slots extending continuously from the bearings to one end of the case for admitting the cam into the bearings as the carrier is inserted into the case. Thus, in the illustrative embodiment the bearings 35 and 36 are formed as apertures in the side walls 60 and 61 of the case 13, and these bearings open into corresponding elongated slots 62 and 63 which extend continuously from the respective bearings to the lower end of the case 13. This permits the cam 30 to be initially assembled along with the carrier 20, with the cam follower 31 being captured within the arcuate cam slot 51 during assembly of the two side plates 22 and 23. Then as the assembled carrier 20 is inserted into the case case 13, the laterally projecting stub shafts 33 and 34 pass upwardly through the slots 62 and 63. As the stub shafts 33 and 34 reach the upper ends of the respective slots 62 and 63, continued upward movement of the carrier 20 causes the shafts 33 and 34 to cam the opposite edges of the slots 62 and 63 away from each other to permit the shafts to enter the corresponding bearings 35 and 36. After the stub shafts 33 and 34 are seated in the bearings 35 and 36, the inherent resiliency of the side walls 60 and 61 of the case 13 cause the edges of the slots 62 and 63 to spring back toward each other to hold the stub shafts 33 and 34 captive within their respective bearings.

To facilitate entry of the carrier 20 into the case 13, a pair of guiding lugs 64 and 65 project inwardly from the opposed end walls of the case 13. These lugs 64 and 65 are preferably formed as integral parts of the case 13. In fact, the entire case 13, including the side walls 60 and 61, the mounting flanges 14 and 15, the bearings 35 and 36, the slots 62 and 63, and the lugs 64 and 65, is formed as a unitary molded plastic member which can be conveniently formed in a single molding operation. The case is preferably formed from a polymeric material which has sufficient resiliency to permit the opposite edges of the slots 62 and 63 to be cammed away from each other during insertion of the stubshafts 33 and 35 into the bearings 35 and 36, and then to spring back with sufficient force to hold the cam shafts securely within the respective bearings.

As can be seen from the foregoing detailed description, this invention provides an improved roller assembly that can be efficiently and economically manufactured from a small number of parts which are easily assembled. In this connection, the cam follower 31 is preferably formed by two inturned circular flanges which are struck out of the side plates 22 and 23 of the carrier 20. Thus, the entire roller assembly can be fabricated from a total of only six parts which can be quickly and easily assembled. Furthermore, the unique construction of the unitary cam member permits adjustment of the roller position in either direction regardless of whether the roller assembly is installed in a door; that is, the weight of the door is not required to effect retracting movement of the roller.

I claim as my invention:

1. A roller assembly for sliding doors and the like adapted for sliding movement along a supporting or guiding track, said roller assembly comprising a case adapted for mounting on the door and forming a cavity that is open at the end adjacent the sliding edge of the door, a carrier located within the cavity of said case and mounted for reciprocating movement relative to the open end of the cavity, at least one roller journaled on said carrier adjacent the open end of said cavity and projecting beyond said case, a cam with a rotatable shaft journaled on said case and a cam follower on said carrier for adjusting the position of said carrier.

said cam comprising a unitary member forming said shaft and an enclosed arcuate slot holding said follower captive therein and extending along an arc that is eccentric with respect to the axis of rotation of the cam, said case comprising a unitary member with the bearings for said cam shaft being formed by a pair of opposed walls of said case, said bearings opening into a pair of slots extending continuously from the bearings to one end of the case for admitting the cam shaft into said bearings as the carrier is inserted into the case.

2. A roller assembly as set forth in claim 1 wherein the case is sufficiently resilient to permit the opposite edges of said slots to be moved away from each other as the cam is urged into said bearings, the opposite edges of said slots then returning to their original positions to hold the cam captive in said bearings.

3. A roller assembly as set forth in claim 1 wherein at least one of the arcuate edges of said slot forms a plurality of detents for positioning the follower at selected locations along the length of the arc.

4. A roller assembly as set forth in claim 3 wherein of the arcuate sidewalls of said slot forms said the other arcuate edge is sufficiently resilient to permit relative movement of the cam and follower between said detent positions.

5. A roller assembly as set forth in claim 1 wherein said cam follower is formed as an integral part of said carrier.

6. A roller assembly as set forth in claim 5 wherein said cam follower is formed by inturned circular flanges struck out of the sidewalls of said carrier.

* * * * *